US011859520B1

(12) United States Patent
Morris et al.

(10) Patent No.: US 11,859,520 B1
(45) Date of Patent: Jan. 2, 2024

(54) EXTENDED PHASER RANGE OF AUTHORITY FOR REDUCED EFFECTIVE COMPRESSION RATIO DURING ENGINE STARTING

(71) Applicant: FCA US LLC, Auburn Hills, MI (US)

(72) Inventors: Andrew L Morris, Clarkston, MI (US); Craig A DeYoung, Milford, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/189,579

(22) Filed: Mar. 24, 2023

(51) Int. Cl.
*F01L 13/08* (2006.01)
*F01L 1/352* (2006.01)

(52) U.S. Cl.
CPC ..... *F01L 13/08* (2013.01); *F01L 1/352* (2013.01); *F01L 2201/00* (2013.01); *F01L 2800/01* (2013.01); *F01L 2800/03* (2013.01)

(58) Field of Classification Search
CPC ..... F01L 1/352; F01L 13/08; F01L 2201/00; F01L 2800/01; F01L 2800/03
USPC ..... 123/90.15, 90.17
See application file for complete search history.

(56) References Cited

U.S. PATENT DOCUMENTS

2010/0000478 A1* 1/2010 Yoshikawa ..... F02N 19/004 123/90.15

OTHER PUBLICATIONS

SAE paper "Application of Electric Cam Phaser System (ECP) for Smooth Engine Starting Behavior in Hybrid Vehicles," 2021-26-0057.

* cited by examiner

*Primary Examiner* — Jorge L Leon, Jr.
(74) *Attorney, Agent, or Firm* — Jeremy J. Klobucar

(57) ABSTRACT

An electronic phaser system configured for use in an engine system is provided. The electronic phaser system comprises an intake camshaft, an electronic phaser and an engine control module (ECM). The intake camshaft has a plurality of camshaft lobes. The electronic phaser couples a gearbox to the intake camshaft. The electronic phaser is configured to rotationally advance the intake camshaft an amount of crank degrees to a desired rotational position. The ECM targets a desired cranking compression ratio based on one of an engine stop request and an engine start request. The ECM converts the desired cranking compression ratio into a camshaft lobe centerline position and commands the electronic phaser to rotate the intake camshaft to the desired rotational position that satisfies the camshaft lobe centerline position to achieve the desired cranking compression ratio. The desired cranking compression ratio is between 5:1 and 6:1.

16 Claims, 5 Drawing Sheets

EXTENDED PHASER RANGE OF AUTHORITY FOR REDUCED EFFECTIVE COMPRESSION RATIO DURING ENGINE STARTING

FIELD

The present application relates generally to camshaft phasers and, more particularly, to an electronic camshaft phaser system used to reduce effective compression ratio during an engine cranking event.

BACKGROUND

Many vehicles having internal combustion engines incorporate engine start/stop (ESS) technology. While ESS technology can have positive impacts on fuel savings, in some examples, starting the internal combustion engine can have negative attributes such as engine noise, vibration, and harshness (NVH) implications. In this regard, it is important to optimize fuel economy, NVH, emissions and performance during engine operation including during ESS events. One method to combat NVH during cranking includes changing the camshaft lobe profile. Such strategy can involve changing the valve opening or closing duration, and/or valve actuation timing relative to the piston top-dead-center (TDC). Another method to combat NVH during cranking is incorporating a variable valvetrain. Such methods can be accomplished by having a shifting camshaft with multiple valve profiles or a variable valve lift mechanism such as a MultiAir valve-lift system commercially provided by the Applicant of the instant disclosure. Such examples can be very costly and/or can have potentially negative performance effects. For example, altering the valve profile could negatively impact engine out emissions and fuel economy during engine operation. Variable valve lift and variable compression ratio engines would add significantly more cost and complexity to the engine. Accordingly, while ESS technology provides fuel savings benefits, there exists an opportunity for improvement in the relevant art.

SUMMARY

In accordance with one example aspect of the invention, an electronic phaser system configured for use in an engine system is provided. In one exemplary implementation, the electronic phaser system comprises an intake camshaft, an electronic phaser and an engine control module (ECM). The intake camshaft has a plurality of camshaft lobes. The electronic phaser couples a gearbox to the intake camshaft. The electronic phaser is configured to rotationally advance or retard the intake camshaft an amount of crank degrees to a desired rotational position. The ECM targets a desired cranking compression ratio based on one of an engine stop request and an engine start request. The ECM converts the desired cranking compression ratio into a camshaft lobe centerline position and commands the electronic phaser to rotate the intake camshaft to the desired rotational position that satisfies the camshaft lobe centerline position to achieve the desired cranking compression ratio. The desired cranking compression ratio is between 5:1 and 6:1.

In addition to the foregoing, the ECM commands the electronic phaser through proportional-integral-derivative (PID) control.

In addition to the foregoing, the electronic phaser is configured to rotationally advance the intake camshaft between 120 and 150 crank degrees. In one example, the electronic phaser is configured to rotationally advance the intake camshaft about 130 crank degrees.

In addition to the foregoing, the ECM targets the desired cranking compression ratio based on an engine stop request and wherein the desired rotational position is achieved at or before an engine of the engine system reaches 0 revolutions per minute (RPM).

In addition to the foregoing, the ECM targets the desired cranking compression ratio based on an engine start request and wherein the desired rotational position is achieved subsequent to an engine of the engine system firing.

In addition to the foregoing, the electronic phaser system further comprises an intake trigger wheel that generates a reference target signal that corresponds to the desired rotational position. In examples, the intake camshaft is configured for use in an early intake valve closing (EIVC) Miller style strategy. In one example, the desired cranking compression ratio is 5:1.

In accordance with another example aspect of the invention, a method for operating an electronic phaser system configured for use in an engine system is provided. In an exemplary implementation, the method includes targeting a desired cranking compression ratio based on one of an engine stop request and an engine start request. The desired cranking compression ratio is converted into a camshaft lobe centerline position of an intake camshaft. The electronic phaser is commanded to rotate the intake camshaft to the desired rotational position that satisfies the camshaft lobe centerline position to achieve the desired cranking compression ratio. The desired cranking compression ratio is between 5:1 and 6:1.

In addition to the foregoing, commanding the electronic phaser comprises rotating the camshaft between 120 and 150 crank degrees. Commanding the electronic phaser in one example includes rotating the camshaft 130 crank degrees.

In addition to the foregoing, the ECM targets the desired cranking compression ratio based on an engine stop request and wherein the desired rotational position is achieved at or before an engine of the engine system reaches 0 revolutions per minute (RPM). In another example, the ECM targets the desired cranking compression ratio based on an engine start request and wherein the desired rotational position is achieved subsequent to an engine of the engine system firing.

In addition to the foregoing, the method further includes receiving a timing signal from an intake trigger wheel. The timing signal corresponds to the measured angular position. The method includes operating the engine system in an early intake valve closing (EIVC) Miller style strategy.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
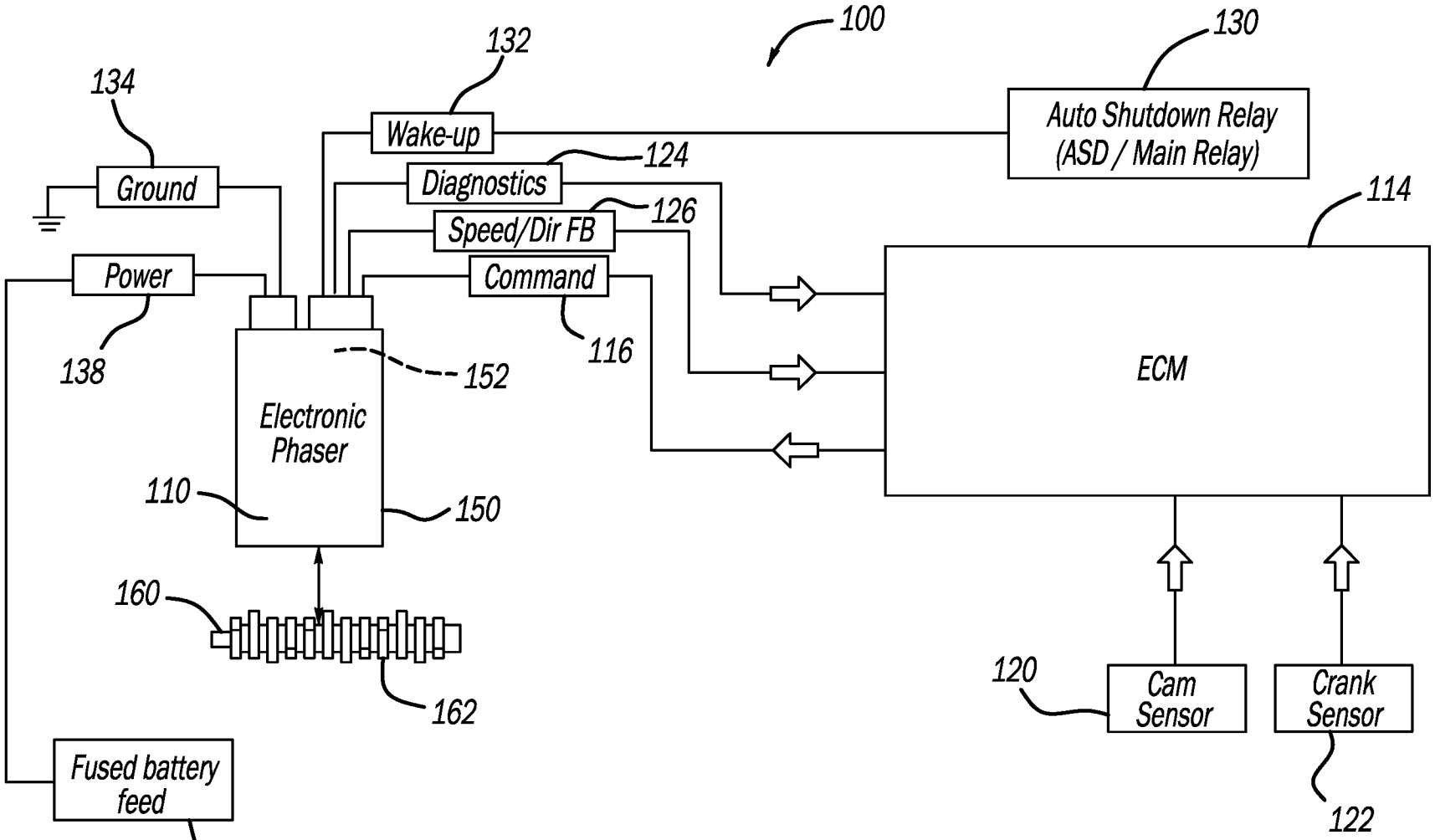
FIG. 1 is a schematic representation of an electronic phaser system according to the principles of the present disclosure.

As previously discussed, there exists an opportunity for improvement in the art of engine noise reduction during starting an internal combustion engine with an engine stop/start technology. Vehicle noise, vibration, and harshness (NVH) can be reduced during cranking by reducing the effective compression ratio during cranking. The effective compression ratio can be reduced by significantly by retarding the intake camshaft during engine cranking. Subsequently, the camshaft can be advanced significantly relative to the crankshaft for better fuel economy during engine firing. The instant engine system allows for the use of an aggressive Miller cycle valve actuation while maintaining seamless engine starting with a simple and cost-effective method. The instant solution requires no additional hardware to the engine thereby reducing cost compared to other techniques. The electronic phaser can be used in place of a hydraulic phaser and is a cost-effective method for reducing cranking NVH.

As described herein, the present disclosure provides an electric phaser for its extended range of authority to reduce the effective compression ratio during an engine cranking event. This enables the benefit of reduced NVH during engine starting, while maintaining engine performance and fuel economy during engine operation. Using an extended range of authority electric phaser (over 75 crank degrees) enables the ability to reduce vehicle NVH during engine cranking while minimizing fuel consumption and emissions when using a cam with an aggressive EIVC strategy.

The effective compression ratio of the engine can be reduced by retarding the intake camshaft during engine cranking. The camshaft can be advanced significantly relative to the crankshaft for better brake-specific fuel consumption (BSFC) during idle and higher engine speeds. As will become appreciated, an added benefit of the instant disclosure is that incorporating electric phasing allows actuation of the phaser during engine cranking prior to engine firing. This is necessary to move the camshaft from a location used for engine cranking to a location used for engine firing. Hydraulic phasers are unable to move the camshaft at low engine speeds for various reasons such as, but not limited to, inadequate camshaft location feedback and insufficient oil pressure.

Camshaft phasers are used to vary camshaft timing relative to the crankshaft and are part of the variable valve timing (VVT) system. Phasers are used to maximize engine performance and fuel economy while minimizing engine out emissions. There are various types of camshaft phasers that can be mainly categorized into electric and hydraulic. A phasers range of authority is the number of crank degrees that the phaser can move the camshaft relative to the crankshaft. A typical maximum range of authority that can be expected from a hydraulic phaser is around 75 crank degrees. One added benefit to using an electric phaser, such as integrated into the instant engine system, is that the range of authority is not limited as much by the geometry of the phaser compared to that of a hydraulic vane-type phaser. Electric phasers can have a range of authority over 75 crank degrees (something that is generally not possible with hydraulic phasers).

The instant disclosure provides an engine system incorporating an electric phaser for its extended range of authority to reduce the effective compression ratio during engine cranking. This enables the benefit of reduced engine starting NVH while maintaining engine performance and fuel economy during engine operation. Electric phasers have many advantages over hydraulic phasers such as an extended range of authority (ROA), phasing can occur during cranking before oil pressure is available. Phasing during cold temperature operation is more attainable with an electric phaser compared to a hydraulic phaser. Cam position is more easily monitored during cranking and shut down. Significantly less oil pressure and flow is required with an electric phaser.

Referring now to FIG. 1, a partial schematic representation of an electronic phaser system 100 that incorporates an electric phaser 110 according to examples of the present disclosure is shown. The electric phaser 110 is controlled and driven based on signals sent by an engine control module (ECM) 114. In particular, the ECM 114 sends a command 116 based on various operating input signals including a cam sensor signal 120, a crank sensor signal 122, a diagnostics signal 124 and a speed/direction feedback signal 126. An automatic shutdown relay module 130 can send a wake-up signal 132 to the electronic phaser 110. The electronic phaser 110 can include a ground 134 and is generally be powered by a fused battery feed 136 that sends power input 138.

Figure 4A:
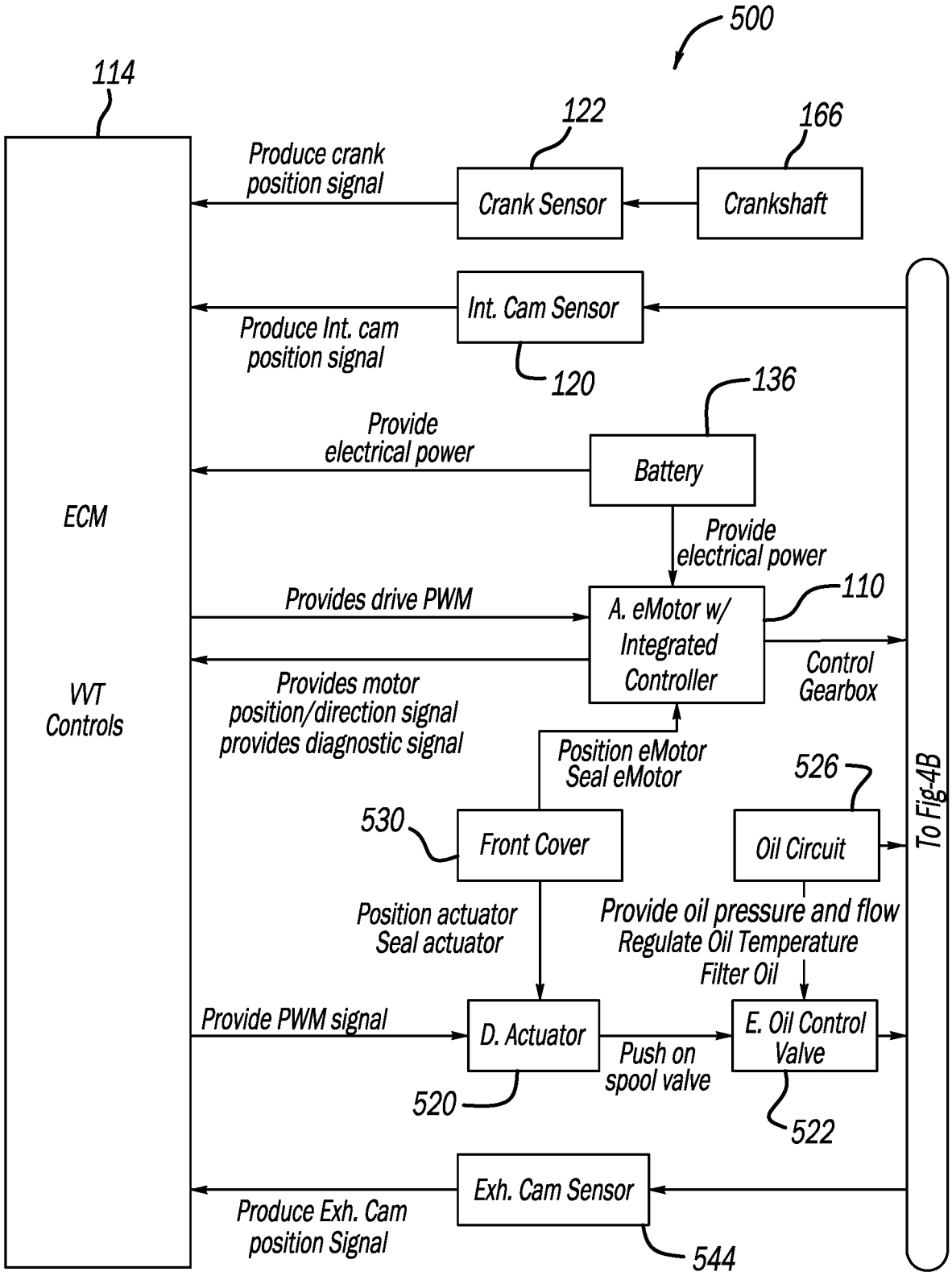
FIGS. 4A and 4B, collectively referred to herein as FIG. 4, is a functional block diagram of an engine system that incorporates an electronic phaser system of FIG. 1 according to various examples of the present disclosure.

The electronic phaser 110 can generally include a motor 150 and a gearbox 152. The electronic phaser 110 is connected to an intake camshaft 160 having lobes 162. The electronic phaser 110 can be connected by any fastening mechanism, shown as a fastener 164 (FIG. 4B) that suitably couples the gearbox 152 to the intake camshaft 160. The motor 150 is generally driven by a chain connected to the crankshaft 166 (FIG. 4A). The electronic phaser 110 therefore modifies the relative position of the intake camshaft 160 and crankshaft 166.

Figure 2:
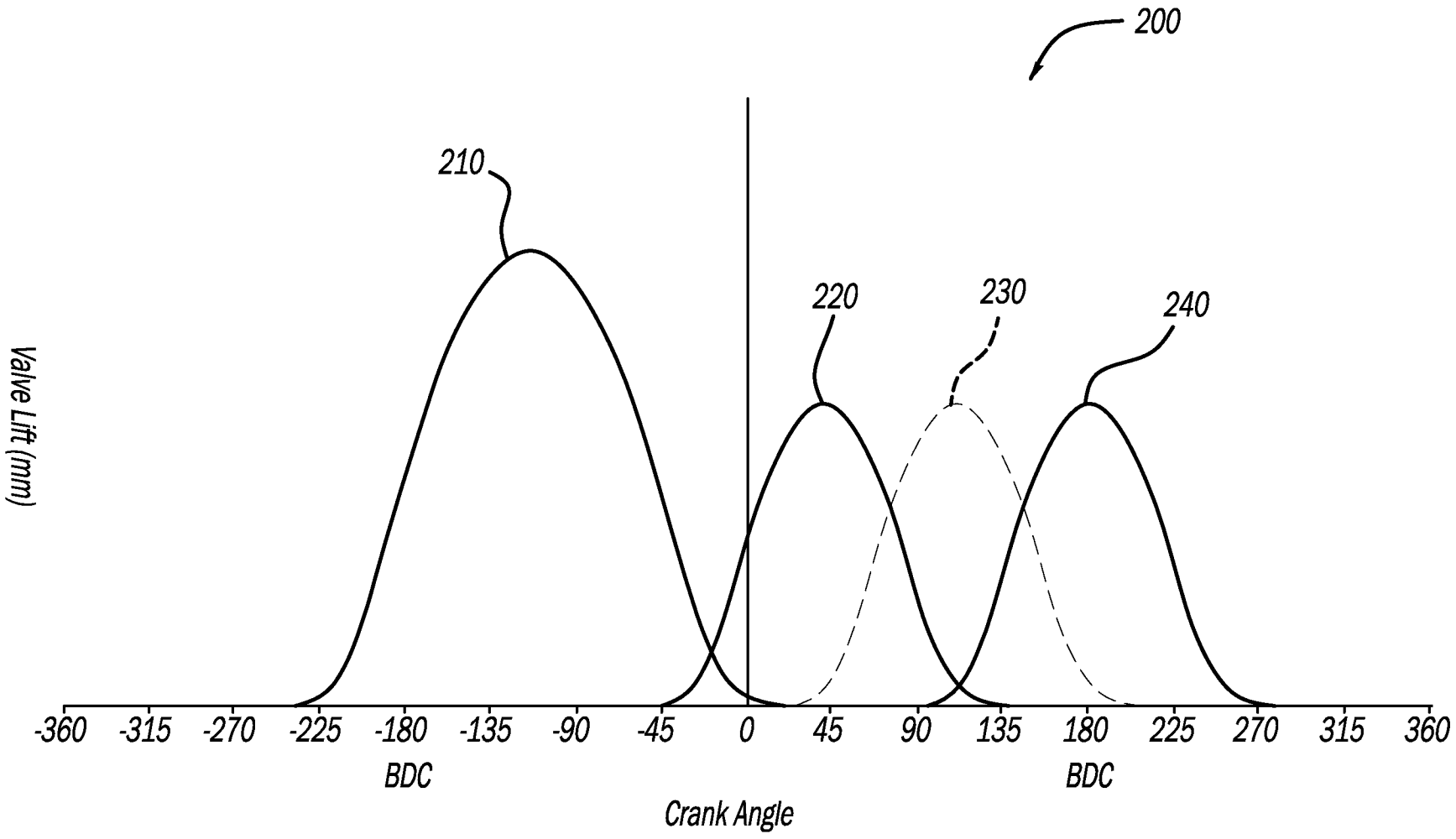
FIG. 2 is an exemplary range of authority plot including valve lift versus crank angle for an exhaust valve, an intake valve incorporating a hydraulic phaser and an intake valve incorporating an electronic phaser according to example of the present disclosure.

Turning now to FIG. 2, a valve lift versus crank angle range of authority diagram is shown and generally identified at 200. An exemplary exhaust valve lift is shown generally at 210. An exemplary intake valve lift is shown generally at 220. An exemplary intake valve lift 230 is shown shifted by a hydraulic phaser (according to a prior art configuration). In general, and as discussed above, a hydraulic phaser can provide a range of authority of around 75 crank degrees. While moving the camshaft around 75 crank degrees is beneficial for NVH, such as during engine cranking, the effective compression ratio is still undesirably high (such as, for example, around 12:1). The range of authority offered by a hydraulic phaser can generally be limited (such as to about 100 crank degrees) by the geometry of the hydraulic phaser.

An exemplary intake valve lift 240 is shown shifted by an electric phaser 110 of the electronic phaser system 100 according to the present disclosure. As shown, the electric phaser 110 can provide a greater phase shift enabling lower compression ratio (such as, for example, around 5:1) for cranking. In the example shown, the electric phaser 110 can move the camshaft 160 about 130 crank degrees. As can be appreciated, a reduced compression ratio at startup will reduce NVH. As used herein around 5:1 can mean between 5:1 and 6:1. Similarly, about 130 crank degrees can mean between 120 and 150 crank degrees.

Figure 3:
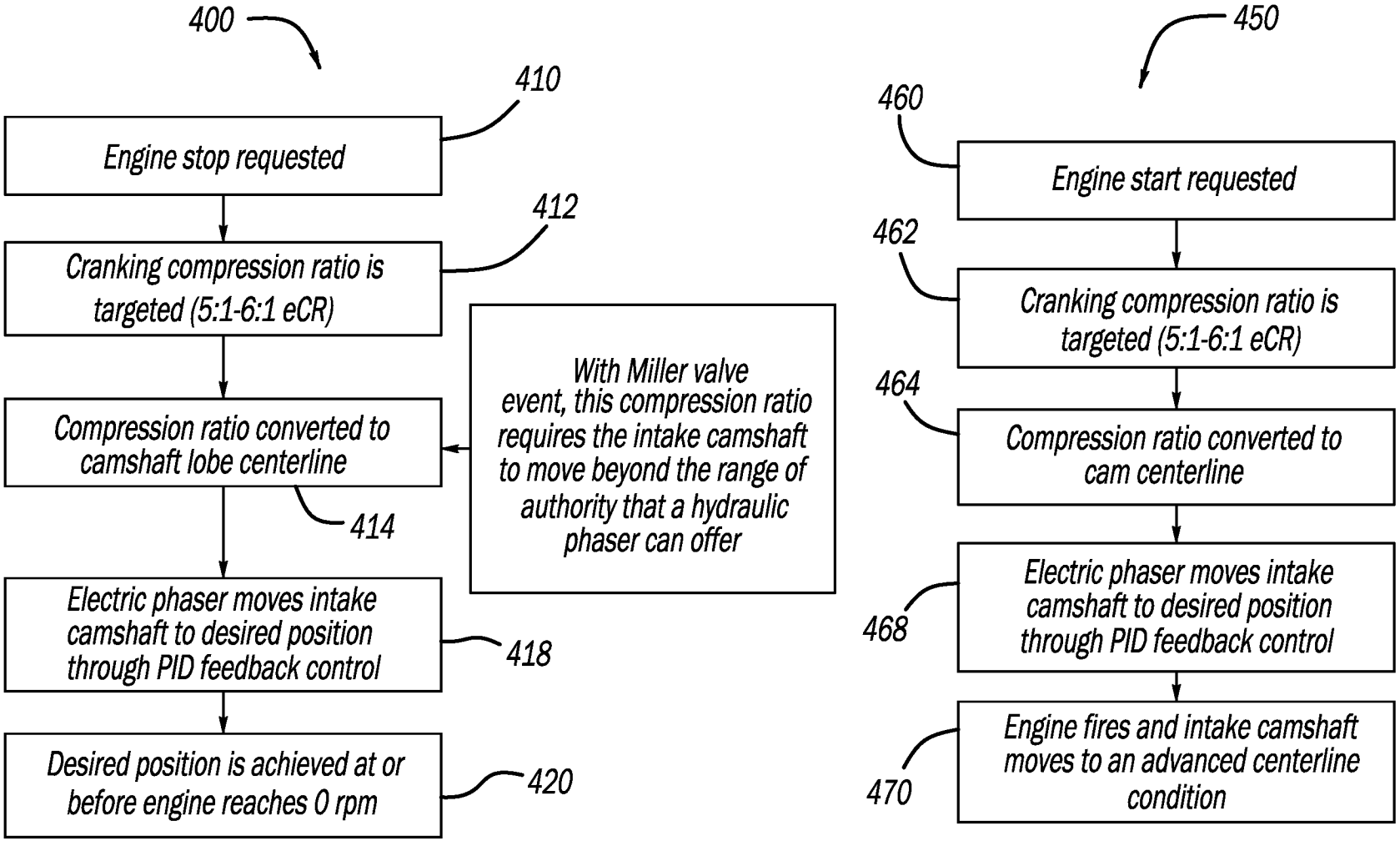
FIG. 3 shows exemplary flow charts for an engine stop request and an engine start request using the electronic phaser system of FIG. 1 according examples of the present disclosure.

With reference to FIG. 3, an exemplary flow chart for an engine stop request 400 and an engine start request 450 using the electronic phaser system of FIG. 1 according to examples of the present disclosure will be described. In general, the engine stop and start requests 400 and 450 can be carried out by commands sent by the ECM 114. For an engine stop request 400, an engine stop is requested at 410. At 412, a cranking compression ratio is targeted. At 414 a compression ratio is converted to camshaft lobe centerline. Of note, with a Miller valve event, this compression ratio requires the intake camshaft 160 to move beyond the range of authority that a hydraulic phaser can offer. With the electronic phaser 110 of the instant disclosure, the desired compression ratio targeted is attainable. At 418, the electric phaser 150 moves the intake camshaft 160 to a desired position through proportional-integral-derivative (PID) feedback control. At 420 the desired position of the intake camshaft 160 is achieved at or before the engine reaches 0 RPM.

For an engine start request 450, an engine start is requested at 460. At 462, a cranking compression ratio is targeted. At 464 a compression ratio is converted to camshaft lobe centerline. At 468, the electric phaser 110 moves the intake camshaft 160 to a desired position through PID feedback control. At 470 the engine fires and the intake camshaft 160 moves to an advanced centerline condition.

Figure 4B:
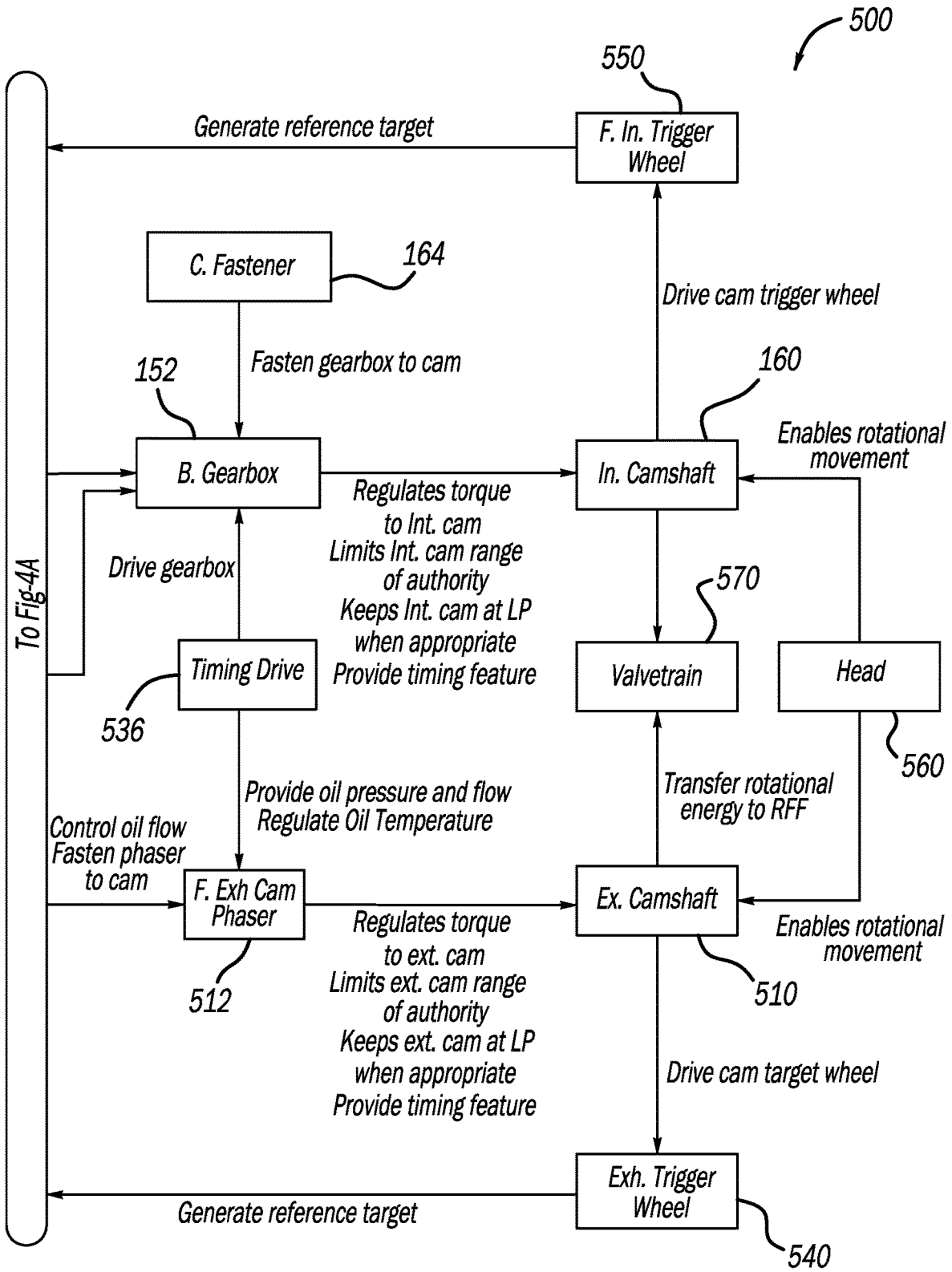

Turning now to FIG. 4 (shown collectively as FIGS. 4A and 4B), an engine system 500 that incorporates the electronic phaser system 100 will be described. In general, the engine system 500 includes the intake camshaft 160 and an exhaust camshaft 510. The exhaust camshaft 510 can be driven by an exhaust cam phaser 512. The exhaust cam phaser 512 can be a hydraulic cam phaser that is generally driven by an actuator 520. An oil control valve 522 fed by an oil control circuit 526 can control an amount of oil pressure at the exhaust cam phaser 512. A front cover 530 includes position and seal actuators for the electric phaser 110 (on the intake side) and the actuator 520 of the phaser 512 (on the exhaust side). The gearbox 152 regulates torque to the intake camshaft 160 and further limits the range of authority. A timing drive 536 provides a timing input to the gearbox 152 and the exhaust cam phaser 512. An exhaust trigger wheel 540 generates a reference target signal to an exhaust cam sensor 544 to produce an exhaust cam position signal. An intake trigger wheel 550 generates a reference target signal to the intake cam sensor 120 to produce an intake cam position signal. In general, a head 560 enables rotational movement of the intake camshaft 160 and exhaust camshaft 510. The intake and exhaust camshafts 160, 510 transfer rotational energy to a roller finger follower (RFF) in valvetrain 570.

As used herein, the term controller or module refers to an application specific integrated circuit (ASIC), an electronic circuit, a processor (shared, dedicated, or group) and memory that executes one or more software or firmware programs, a combinational logic circuit, and/or other suitable components that provide the described functionality.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. An electronic phaser system for use in an engine system, the electronic phaser system comprising:

an intake camshaft including a plurality of camshaft lobes;

an electronic phaser that couples a gearbox to the intake camshaft, the electronic phaser configured to rotationally adjust the intake camshaft to a target rotational position relative to a crankshaft of the engine system; and an engine control module (ECM) configured to:

(i) determine an optimal cranking compression ratio based on one of an engine stop request and an engine start request;

(ii) convert the optimal cranking compression ratio into a camshaft lobe centerline position; and (iii) command the electronic phaser to rotate the intake camshaft to the target rotational position which corresponds to the camshaft lobe centerline position so as to achieve the optimal cranking compression ratio;

wherein the optimal cranking compression ratio is at least 5:1 and at most 6:1.

2. The electronic phaser system of claim 1, wherein the ECM commands the electronic phaser through proportional-integral-derivative (PID) control.

3. The electronic phaser system of claim 1, wherein the electronic phaser includes a range of authority of at least 120 crank degrees and at most 150 crank degrees.

4. The electronic phaser system of claim 1, wherein the ECM determines the optimal cranking compression ratio based on the engine stop request, and wherein the target rotational position is achieved at or before an engine of the engine system reaches 0 revolutions per minute (RPM).

5. The electronic phaser system of claim 1, wherein the ECM determines the optimal cranking compression ratio based on the engine start request, and wherein the target rotational position is achieved subsequent to a firing of an engine of the engine system.

6. The electronic phaser system of claim 1, further comprising:

an intake trigger wheel that generates a reference target signal corresponding to the target rotational position.

7. The electronic phaser system of claim 1, wherein the engine system further comprises:

an exhaust camshaft.

8. The electronic phaser system of claim 1, wherein the intake camshaft is configured to operate in an early intake valve closing (EIVC) Miller style strategy.

9. The electronic phaser system of claim 1, wherein the optimal cranking compression ratio is 5:1.

10. A method for operating an electronic phaser system of an engine system, the method comprising:

determining an optimal cranking compression ratio based on one of an engine stop request and an engine start request;

converting the optimal cranking compression ratio into a camshaft lobe centerline position of an intake camshaft; and commanding an electronic phaser of the electronic phaser system to rotate the intake camshaft to a target rotational position which corresponds to the camshaft lobe centerline position so as to achieve the optimal cranking compression ratio, wherein the optimal cranking compression ratio is at least 5:1 and at most 6:1.

11. The method of claim 10, wherein the commanding of the electronic phaser:

includes a range of authority of at least 120 crank degrees and at most 150 crank degrees.

12. The method of claim 10, wherein the determining of the optimal cranking compression ratio is based on the engine stop request, and wherein the target rotational position is achieved at or before an engine of the engine system reaches 0 revolutions per minute (RPM).

13. The method of claim 10, wherein the determining of the optimal cranking compression ratio is based on the engine start request, and wherein the target rotational position is achieved subsequent to a firing of an engine of the engine system.

14. The method of claim 10, further comprising:

receiving a timing signal from an intake trigger wheel, the timing signal corresponding to a measured angular position.

15. The method of claim 10, further comprising:

operating the engine system in an early intake valve closing (EIVC) Miller style strategy.

16. The method of claim 10, wherein the optimal cranking compression ratio is 5:1.

* * * * *